US010870505B2

(12) United States Patent
Smith et al.

(10) Patent No.: US 10,870,505 B2
(45) Date of Patent: Dec. 22, 2020

(54) ARTICLES AND METHODS FOR FORMING LIQUID FILMS ON SURFACES, IN DEVICES INCORPORATING THE SAME

(71) Applicant: LiquiGlide Inc., Boston, MA (US)

(72) Inventors: J. David Smith, Cambridge, MA (US); Kripa Varanasi, Lexington, MA (US); Brian Jordan, Winchester, MA (US); Carsten Boers, Cambridge, MA (US)

(73) Assignee: LiquiGlide Inc., Boston, MA (US)

( * ) Notice: Subject to any disclaimer, the term of this patent is extended or adjusted under 35 U.S.C. 154(b) by 763 days.

(21) Appl. No.: 14/488,746

(22) Filed: Sep. 17, 2014

(65) Prior Publication Data

US 2015/0079315 A1 Mar. 19, 2015

Related U.S. Application Data

(60) Provisional application No. 61/878,788, filed on Sep. 17, 2013.

(51) Int. Cl.
*B32B 37/02* (2006.01)
*B65B 3/04* (2006.01)
(Continued)

(52) U.S. Cl.
CPC ..... *B65B 3/04* (2013.01); *B65B 3/16* (2013.01); *B65B 29/00* (2013.01); *B65D 23/02* (2013.01);
(Continued)

(58) Field of Classification Search
CPC ..... B32B 27/10; B65D 65/466; Y10T 428/31993; Y10T 428/31544;
(Continued)

(56) References Cited

U.S. PATENT DOCUMENTS 5,296,282 A 3/1994 Evers
6,247,603 B1 6/2001 Farrell et al.
(Continued)

FOREIGN PATENT DOCUMENTS

EP 1 992 420 A1 11/2008
EP 3 046 755 A1 7/2016
(Continued)

OTHER PUBLICATIONS

International Search Report and Written Opinion, dated Dec. 31, 2014 for PCT/US2014/056036, filed Sep. 17, 2014.
(Continued)

*Primary Examiner* — Ellen S Hock
(74) *Attorney, Agent, or Firm* — Cooley LLP

(57) ABSTRACT

Embodiments described herein relate to articles and methods for forming liquid surface films on the interior surfaces of containers for holding one or more products comprising one or more Bingham plastic materials. Bingham plastic materials behave as a solid under no or low shear stress, and behave as viscous liquids when an applied shear stress exceeds a yield stress. In some embodiments, a container for containing a product includes an interior surface and a liquid disposed on the interior surface. Before introduction of a product into a container, the liquid may be surrounded by air. The liquid-air interface in contact with the interior surface makes a contact angle, $\theta_{os(a)}$, with respect to the interior surface of the container, of about 0°. After a product has been introduced to the container, the liquid is at least partially covered by the product. The liquid-product interface in contact with the interior surface, makes a contact angle, $\theta_{os(p)}$, with respect to the interior surface, of less about 60°. The subscript "o" denotes the liquid, subscript "s" denotes the interior surface, subscript "a" denotes air, and subscript "p" denotes a product. In some embodiments, the
(Continued)

contact angle $\theta_{os(p)}$ can be less than about 50°, less than about 40°, or less than about 30°.

21 Claims, 8 Drawing Sheets

(51) Int. Cl.

| | |
|---|---|
| ***B65B 3/16*** | (2006.01) |
| ***B65B 29/00*** | (2006.01) |
| ***B65D 23/04*** | (2006.01) |
| ***B65D 23/02*** | (2006.01) |
| ***B65D 25/14*** | (2006.01) |

(52) U.S. Cl.
CPC ..... *B65D 23/04* (2013.01); *B65D 25/14* (2013.01); *B65D 2231/001* (2013.01); *B65D 2231/005* (2013.01); *Y10T 428/13* (2015.01)

(58) Field of Classification Search
CPC ..... Y10T 428/24851; Y10T 428/24405; Y10T 428/24802
USPC ..... 428/34.1, 35.7
See application file for complete search history.

(56) References Cited

U.S. PATENT DOCUMENTS

| | | | |
|---|---|---|---|
| 8,535,779 | B1 | 9/2013 | Smith et al. |
| 8,574,704 | B2 | 11/2013 | Smith et al. |
| 8,940,361 | B2 | 1/2015 | Smith et al. |
| 2006/0083879 | A1 | 4/2006 | Brewis et al. |
| 2007/0134470 | A1 | 6/2007 | Jesberger et al. |
| 2013/0032316 | A1 | 2/2013 | Dhiman et al. |
| 2013/0140649 | A1 | 6/2013 | Rogers et al. |
| 2014/0178611 | A1 | 6/2014 | Smith et al. |
| 2014/0305900 | A1 | 10/2014 | Rogers et al. |
| 2015/0306642 | A1 | 10/2015 | Smith et al. |

FOREIGN PATENT DOCUMENTS

| | | | |
|---|---|---|---|
| WO | WO 2002/042069 | A1 | 5/2002 |
| WO | WO 2012/100099 | A2 | 7/2012 |
| WO | WO 2013/022467 | A2 | 2/2013 |
| WO | WO 2013/036042 | A1 | 3/2013 |
| WO | WO 2013/087385 | A1 | 6/2013 |
| WO | WO 2013/141888 | A1 | 9/2013 |
| WO | WO 2014/078867 | A1 | 5/2014 |
| WO | WO 2015/039085 | A1 | 3/2015 |

OTHER PUBLICATIONS

European Search Report, dated Jun. 23, 2017 for European Patent Application No. 14846002.5, filed Sep. 17, 2014.
Examination Report dated Aug. 16, 2018 for European Application No. 14846002.5, 6 pages.
Communication Pursuant to Article 94(3) dated Mar. 21, 2019 for European Application No. 14846002.5, 5 pages.
Communication Pursuant to Article 94(3) dated Feb. 18, 2020 for European Application No. 14846002.5, 7 pages.

ARTICLES AND METHODS FOR FORMING LIQUID FILMS ON SURFACES, IN DEVICES INCORPORATING THE SAME

CROSS-REFERENCE TO RELATED APPLICATIONS

This application claims priority to and the benefit of U.S. Provisional Application No. 61/878,788, entitled "Articles and Methods for Forming Liquid Films on Surfaces, in Devices Incorporating the Same," filed Sep. 17, 2013, the disclosure of which is incorporated herein by reference in its entirety.

BACKGROUND

Bingham plastics are a class of materials that exhibit little or no deformation up until a certain yield stress is reached. Examples of Bingham plastics are toothpaste, ketchup, margarine, mayonnaise, uncured cement, uncured concrete, bitumen, grease, some molten polymers, and some paints. Because Bingham plastics behave as solids under no or low shear stress, and do not readily flow, they can be difficult to dispense. As a result, manufacturers are constrained to a limited set of container designs and materials for packaging Bingham plastics. There is a need for containers with surfaces that promote and/or ease the dispensing of Bingham plastics. In particular, there is a need for containers with interior surfaces that facilitate the removal of Bingham plastic products without contamination or adulteration of the Bingham plastic products.

SUMMARY

Embodiments described herein relate generally to containers with liquid films on one or more surfaces thereof, and methods for applying such films. Specifically, the present disclosure relates to containers having liquid films on their interior surfaces and configured to hold Bingham plastic materials. For example, containers of the present disclosure are designed for packaging, surrounding, wrapping, encasing, encapsulating, or otherwise containing products that are Bingham plastic materials. In some embodiments, a container for containing a product includes an interior surface and a liquid disposed on the interior surface. In some embodiments, the liquid has a contact angle, $\theta_{os(a)}$, equal to 0°, and has a contact angle, $\theta_{os(p)}$, of between about 0° and about 60°, between about 1° and about 60°, between about 5° and about 50°, between about 5° and about 40°, between about 5° and about 30°, between about 0° and about 30°, between about 1° and about 30°, between about 1° and about 40°, between about 1° and 50°, or about 60°, where "o" denotes the liquid, "s" denotes the interior surface, "a" denotes air, and "p" denotes a product. In some embodiments, the product is a Bingham plastic material that behaves as a solid below a certain threshold of shear stress (e.g. from an external for or by gravity), known as the yield stress of the Bingham plastic. Above the yield stress, a Bingham plastic behaves, or "flows," like a liquid.

DETAILED DESCRIPTION

Figure 1:
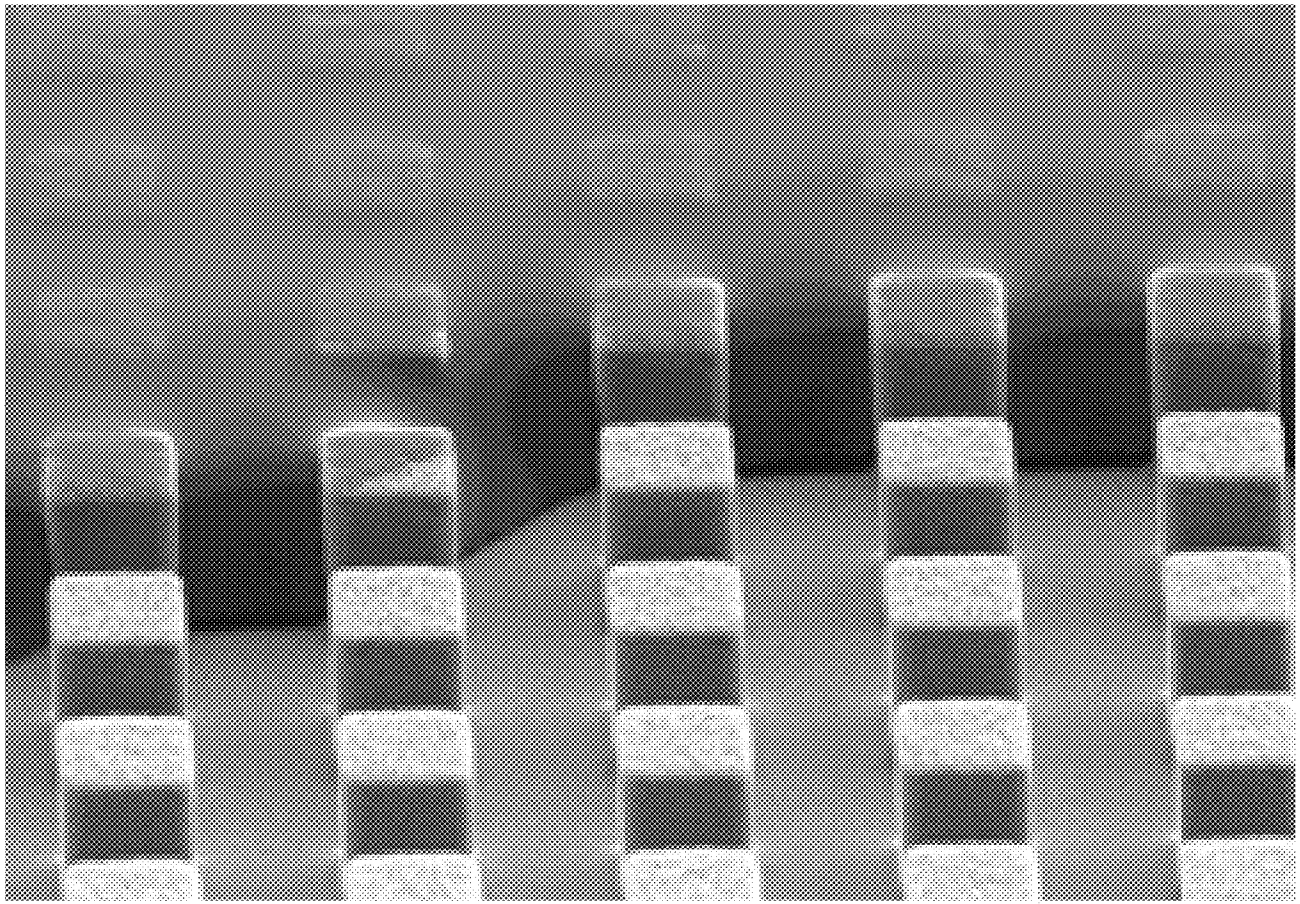
FIG. 1 Prior Art
FIG. 1 is a scanning electron micrograph of a surface having solid features and an impregnation liquid, according to an embodiment.

Bingham plastics are a class of materials that exhibit little or no deformation up until a certain yield stress is reached, at which point, they begin to flow. They behave as solids under no or low shear stress, and as viscous liquids when an applied shear stress exceeds a yield stress. Specifically, for purposes of the instant disclosure, a "Bingham plastic" refers to any material that does not substantially deform plastically (or "flow) until a yield stress is reached. Unlike many liquids that readily flow from containers, Bingham plastics typically require an applied force to initiate dispensing (i.e., once the applied shear stress is greater than the yield stress, viscous flow begins). Examples of Bingham plastics include toothpaste, ketchup, margarine, mayonnaise, uncured cement, uncured concrete, bitumen, grease, some molten polymers, and some paints.

Because Bingham plastics behave as solids under no or low shear stress, and do not readily flow, they can be difficult to dispense. Consumers waste billions of dollars worth of product each year due to the fact that many consumer products, including Bingham plastics, adhere to their containers and are difficult to remove. This limits manufacturers' ability to use certain container designs and materials. For example, manufacturers often employ deformable containers whereby the consumer squeezes the walls of the container to apply a stress to the Bingham plastic and initiate viscous flow. Manufacturers typically select materials that are capable of being repeatedly deformed so that the consumer can apply a force onto the Bingham plastic product. Manufacturers may also reduce the viscosity of the Bingham plastic product to facilitate dispensing. This means that there is proportionately less of the active ingredient(s) in the product, due to the presence of viscosity modifiers or solvents, than there would be without the need for such additives. As an alternative approach, some manufactures use rigid containers with large openings which require a user to directly access the Bingham plastic product and to manually remove it. These types of rigid containers have drawbacks such as requiring additional tools to remove the product, limited container design choices, and increased manufacturing costs. Small-mouthed, rigid containers often require the user to shake the container to apply an inertial force to the Bingham plastic product to initiate flow. Shaking the container can result in the product being incorrectly applied in the amount and/or location, strain on the consumer, and container breakage.

Another problem with dispensing Bingham plastic materials is that they are prone to stick or otherwise adhere to the inner walls of the container. Unlike many liquids which will eventually flow back and settle to the bottom of a container under the force of gravity, Bingham plastic materials often adhere to walls and do not flow until subjected to at least a minimum yield stress. In some container configurations, it is difficult or impossible for a user to practically apply the requisite yield stress to portions of product that are stuck to inner walls of a container, for example when a majority of the product has been removed. This frequently results in wasted product that is ultimately discarded along with the container.

Applying embodiments described herein to consumer containers and packaging can eliminate waste since nearly 100% of the product can be evacuated (i.e., removed, dispensed, and/or the like) from the container, making the production, consumption, and disposal of the product and its packaging more environmentally friendly. In some embodiments, coated containers described herein allow for the use of higher concentration consumer product formulations, with higher viscosities, than was previously possible. Manufacturers using coatings and/or coated containers according to the present disclosure will have greater flexibility when innovating their product formulations. For example, products can be made thicker, and can be made at higher concentrations (e.g., through elimination of the need for additives such as solvents or water), allowing for the size of the packaging to shrink without sacrificing value to the consumer. Smaller packaging also means that more containers fit in a fixed shipment volume, resulting in lower transport costs and fuel emissions since fewer shipments are necessary. Additional advantages include the elimination of the need for bulky squeeze caps and pump systems that are commonly used for dispensing consumer products from containers. Eliminating these expensive caps and dispensers can reduce packaging costs and eliminate millions of tons of petroleum-based plastics from ending up in landfills each year Embodiments described herein can also result in significant cost saving benefits for manufacturing processes. For example, less product adhesion along product delivery lines and piping results in fewer and/or less frequent cleaning cycles, and allows for increased production. As a result, less product waste is generated during the production process, saving resources and making the process and the company more environmentally friendly.

In some embodiments, a container for containing a product includes an interior surface and a liquid disposed on the interior surface. When disposed on the interior surface of the container, the liquid exhibits a "contact angle," e.g., with respect to the interior surface on which it is disposed. The contact angle may vary depending upon the properties of one or more "phases" (e.g., solid, semi-solid, immiscible liquid, gas, etc.) adjacent to the liquid. Contact angles are hereinafter referred to using the symbol "θ," with subscripts identifying the materials forming the interface and adjacent phase at which point the contact angle is measured. The subscript "o" denotes liquid, subscript "s" denotes the interior surface, subscript "a" denotes air, and subscript "p" denotes a product. In some embodiments of the present disclosure, a liquid-air interface has a contact angle $\theta_{os(a)}$ of 0° (e.g., a "fully wetted" state), and a liquid-product interface also has a contact angle $\theta_{os(p)}$, of 0°. Contact angle $\theta_{os(p)}$ refers the angle made between a solid-liquid and liquid-product interface in a system where a solid is intercepted by the liquid-product interface. In some embodiments of the present disclosure, a liquid-air interface has a contact angle $\theta_{os(a)}$ of 0° (e.g., a "fully wetted" state), and a liquid-product interface also has a contact angle $\theta_{os(p)}$, of between about 0° and about 60°, between about 1° and about 60°, between about 5° and about 50°, between about 5° and about 40°, between about 5° and about 30°, between about 0° and about 30°, between about 1° and about 30°, between about 1° and about 40°, or between about 1° and about 50°. In one embodiment, the liquid-air interface in contact with an interior surface of the container has a contact angle, $\theta_{os(a)}$, with respect to the interior surface of the container, of between 0° and 5°, and once a product has been introduced, a liquid-product interface in contact with an interior surface of the container makes a contact angle $\theta_{os(p)}$, with respect to the interior surface of the container, of between about 0° and about 60°, between about 1° and about 60°, between about 5° and about 50°, between about 5° and about 40°, between about 5° and about 30°, between about 0° and about 30°, between about 1° and about 30°, between about 1° and about 40°, or between about 1° and 50°. In some embodiments, a container for containing a product includes an interior surface and a liquid having a density disposed on the surface. A product, having a density, is disposed within the container. In some embodiments, the density of the product is about equal to (e.g., +/−10% of) the density of the liquid, the liquid-air interface makes a contact angle, $\theta_{os(a)}$, with respect to the interior surface of the container, equal to about 0°, and once a product has been introduced, a liquid-product interface in contact with the interior surface of the container makes a contact angle, $\theta_{os(p)}$, with respect to the interior surface of the container, of between about 0° and about 60°, or between about 0° and about 50°, or between about 1° and about 40°, or between about 0° and about 30°, or of less than or equal to 30°.

In some embodiments, a method of manufacturing a packaged product includes disposing a liquid onto an interior surface of a container and transferring a product into the container. In some such embodiments, the liquid is introduced into the container first, and the product is subsequently introduced into the container. In other embodiments, the liquid and product are provided to the container simultaneously, and the liquid is first in contact with the product, and subsequently in contact with the container. In some such embodiments, a liquid-air interface in contact with the interior surface of the container makes a contact angle, $\theta_{os(a)}$, with respect to the interior surface, of about 0°, and a liquid-product interface in contact with an interior surface of the container, makes a contact angle, $\theta_{os(p)}$, with respect to the interior surface, of between about 0° and about 30°. In still further embodiments, the liquid is applied to the product first, and then the liquid-coated product is subsequently introduced into the container.

In some embodiments, an apparatus for storing a flowable product includes a container having an interior surface (e.g., one or more walls) that defines an inner volume. A liquid, having a first density, is disposed on at least a portion of the interior surface of the container, such that a contact angle, $\theta_{os(a)}$, made by a liquid-air interface in contact with the interior surface of the container, equals about 0°. In some such embodiments, the container also includes a product (having, for example, a second density approximately equal to the first density) disposed within the inner volume of the container, and a contact angle, $\theta_{os(p)}$, made by a liquid-product interface in contact with the interior surface, is less than about 30° (e.g., between about 0° and about 30°). As described hereinbefore, the subscript letter "o" denotes the liquid, subscript "s" denotes the interior surface, subscript "a" denotes air, and subscript "p" denotes a product.

As used herein, the term "about" or "approximately" generally means plus or minus 10% of the value stated. For example, "about 5" would include 4.5 to 5.5, "about 10" would include 9 to 11, and "about 100" would include 90 to 110.

FIG. 1 shows a "liquid-impregnated" surface that is suitable for a variety of applications. In preparing liquid-impregnated surfaces, liquids are introduced (i.e., "impregnated") into and/or onto a surface that includes an arrangement (e.g., a matrix, ordered pattern, random pattern, pseudo-random pattern, and/or other configuration) of solid and/or semi-solid features defining interstitial regions in the space(s) between the features, such that the interstitial regions include "pockets," or discrete volumes, of impregnating liquid. The impregnating liquid (e.g., by virtue of its composition, material properties, etc.) and/or the features (e.g., by virtue of their composition, geometry, and/or spacing) are configured such that the impregnating liquid wets the solid surface preferentially, and adheres to the micro-textured surface with strong capillary forces. The resulting "surface," comprising both the features and the impregnating liquid, may collectively be referred to as a "liquid-impregnated surface." The impregnating liquid component of the liquid-impregnated surface enables an extremely low roll off (or slide-off) angle of a liquid (i.e., a "contact liquid") that is in contact with the liquid-impregnated surface. For example, the liquid-impregnated surface may enable a roll-off (or slide-off) angle of about 1 degree.

Figure 2:
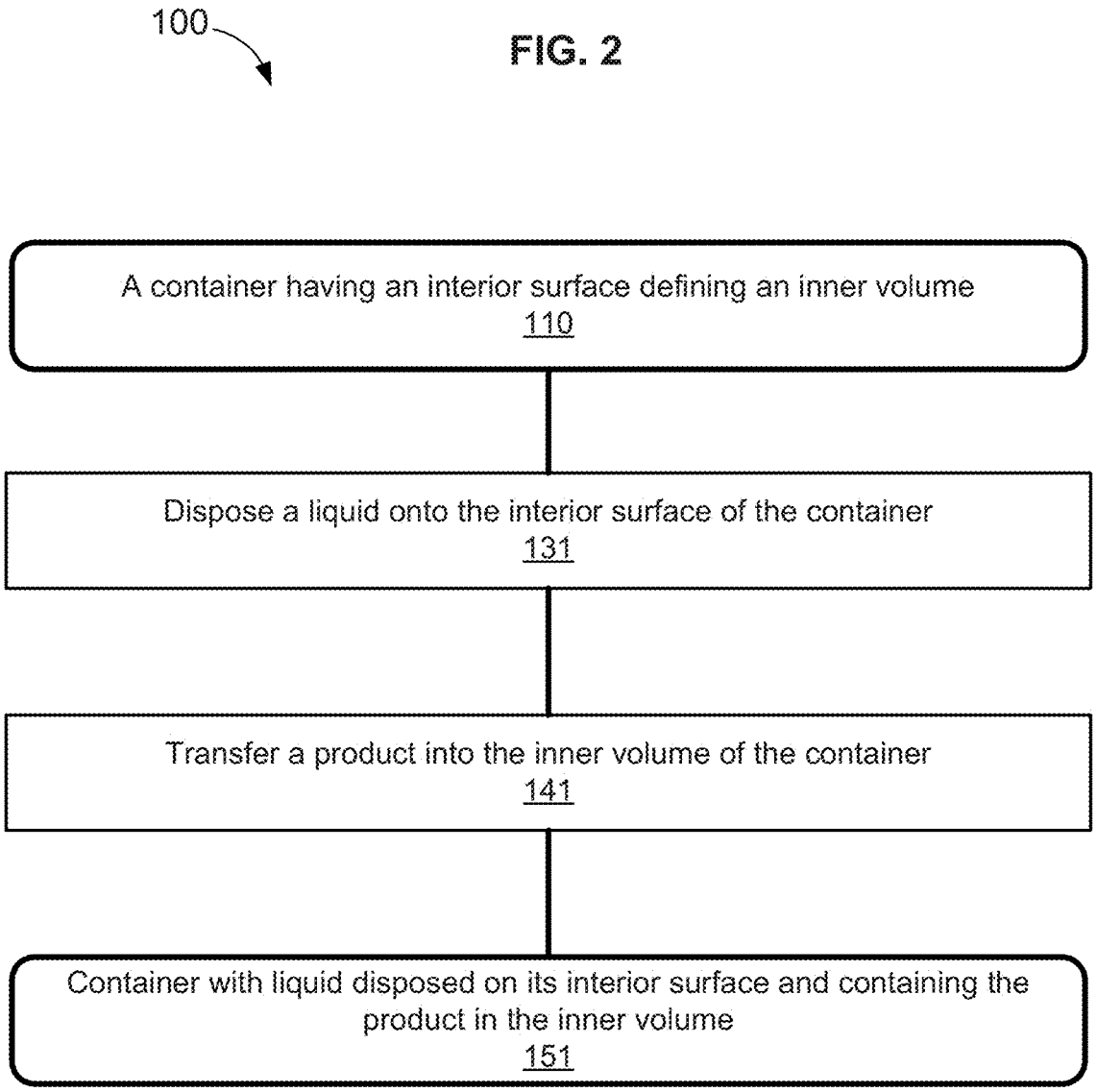
FIG. 2 is a flow chart of a method of forming a liquid surface film, according to an embodiment.

FIG. 2 is a flow chart illustrating an exemplary method of manufacturing a packaged product 100 in a container 110 having an interior surface defining an inner volume. At step 131, a liquid is disposed on the interior surface of the container 110. In some embodiments, the liquid is disposed (e.g., by spraying, pouring, spreading, misting, condensing, brushing, immersion, and/or any other suitable technique such as those described herein) onto the interior surface of the container 110, resulting in a coated container (i.e., the container bears a liquid surface film). In some embodiments, excess liquid is removed after an initial coating process. At step 141, a product to be contained (e.g., a Bingham plastic product) is transferred into the inner volume of the container (e.g., by way of a nozzle, funnel, pipe, tube, and/or other suitable delivery device, and/or the like), resulting in the container having the liquid disposed on its interior surface and containing the product in the inner volume 151. At the end of such process, the product may be said to be at least partially "coated by" the liquid, since the liquid surface film forms an interface between the contained product and the interior surface of the container (e.g., the container wall(s)) and is in contact with the contained product.

In some embodiments, a product to-be-contained (e.g., a Bingham plastic product) itself coated with a liquid as it is being transferred to the container 110 (e.g., by way of a nozzle, funnel, pipe, tube, and/or other suitable delivery device, and/or the like), resulting in the container having the liquid disposed on its interior surface and containing the product in the inner volume 151. In other words, the act of transferring the product into the inner volume of the container causes the liquid to become disposed on the interior surface of the container. In such embodiments, the product may be said to be a "carrier" for the liquid, transporting it into the inner volume of the container as it is dispensed. The act of transferring the product into the inner volume of the container, e.g. at 141, may thus be said to occur prior to or concurrently with disposing the liquid onto the interior surface of the container, e.g., at 131). At the end of such processes, the liquid that first coated the product may be said to also "coat" the interior surface of the container, since the liquid coating carried by coated product makes contact with at least a portion of the container wall(s) and forms an interface (i.e., a liquid surface film) between the contained product and the container wall(s).

In some embodiments, a method of manufacturing a packaged product 100 comprises at step 131, disposing a liquid onto the interior surface of the container, substantially concurrently with the step 141 of transferring a product (e.g., a Bingham plastic product) into the inner volume of the container, for example during introduction of said product into container 110 (e.g., by way of a coaxial nozzle, an extrusion tool, and/or a combination of pipe, tube, spray, and/or other suitable delivery mechanisms in simultaneous operation, and/or the like), resulting in a container with liquid disposed on its interior surface and containing the product in the inner volume 151. In such embodiments, for example, the liquid may be dispensed into the container around the edges of an opening therein, while the product is dispensed at or near the center of said opening. As such, as the liquid may "wet" the interior surface (e.g., the walls) of the container as it is being filled, and as the product fills the inner volume of the container, it comes into contact with the liquid-coated interior surfaces. In some embodiments involving substantially concurrent dispensing of the liquid and the product, the dispensing of the liquid may commence slightly prior to the dispensing of the product, to ensure full coverage of the liquid on the interior surface of the container.

At the conclusion of any of the above-described exemplary methods, the finished product (i.e., a manufactured, packaged product) 151 collectively comprises the contained product, and container 110 with its interior surface coated with the liquid, the liquid providing a low surface energy boundary surrounding the product. The liquid prevents the product from adhering to the interior surfaces of the container 110, and facilitates complete or substantially complete discharge of the product.

The container 110 can be any suitable container for containing a Bingham plastic product. Examples of suitable containers include tithes, bottles, vials, flasks, molds, jars, tubs, bags, pouches, boxes, tins, capsules, cups, glasses, pitchers, barrels, bins, totes, tanks, kegs, tubs, syringes, tins, pouches, lined boxes, hoses, cylinders, and cans. The container 110 can be constructed in any desirable shape, as the container does not have the typical constraint of product being easily trapped in sharp corners or intricate detail. Furthermore, greater surface-to-volume ratio shapes than typical can work and still enable the product to flow. For example packaging shaped like animals, narrow rectangular shapes or prisms, spirals or tubes, Additionally, embodiments described herein can be applied to hoses, piping, conduit, nozzles, faucets, apertures, spray heads, syringe needles, dispensing tips, lids, pumps, and other surfaces for containing, transporting, and/or dispensing Bingham plastic products.

The container 110 can be constructed of any suitable material, including plastic, glass, metal, ceramic, composite, wood, coated fibers, and combinations thereof. Suitable surfaces can include, for example, polystyrene, nylon, polypropylene, wax, polyethylene terephthalate, polypropylene, polyethylene, polyurethane, polysulphone, polyethersulfone, polytetrafluoroethylene (PTFE), tetrafluoroethylene (TFE), fluorinated ethylenepropylene copolymer (FEP), polyvinylidene fluoride (PVDF), perfluoroalkoxytetrafluoroethylene copolymer (PFA), perfluoromethyl vinylether copolymer (MFA), ethylenechlorotrifluoroethylene copolymer (ECTFE), ethylene-tetrafluoroethylene copolymer (ETFE), perfluoropolyether, Tecnoflon cellulose acetate, and polycarbonate. The container 110 can be constructed of rigid and/or flexible materials, and in some embodiments may be "lined." For example, foil-lined or polymer-lined cardboard or paper boxes can also form suitable containers. The container 110 can have an interior surface that is solid, compliant, smooth, textured, rough, and/or porous.

Figure 3:
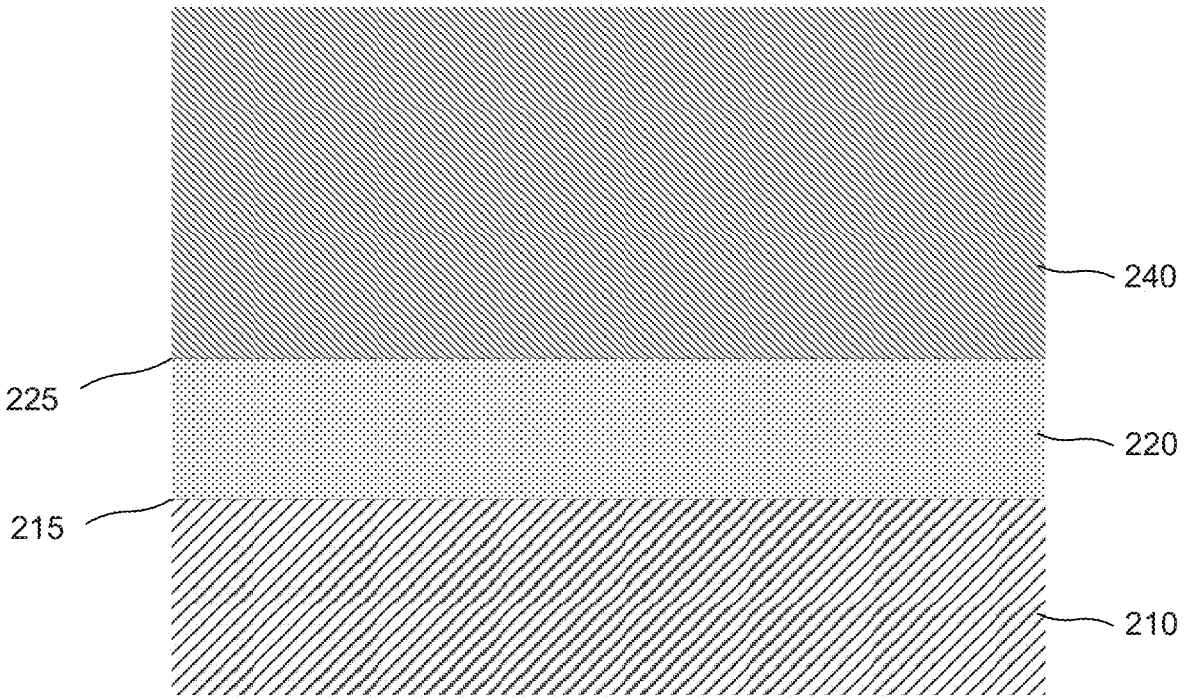
FIG. 3 is a cross-section view of a product in a liquid coated container, according to an embodiment.

FIG. 3 illustrates a cross-section view of a product in a liquid-coated container according to some embodiments of the present disclosure. The wall of container 210 has a surface 215 that is proximate to a liquid 220. A product 240, a Bingham plastic material, is proximate to the liquid 220 (the interface therebetween is shown at 225). The liquid 220 forms a liquid "film" that wets the surface 215, substantially preventing the product 240 from coming into contact with the surface 215 of container 210.

The liquid of the present disclosure can also be referred to as a lubricant. Suitable liquids include, for example, one or more of the following: vegetable oils, lipids, triglycerides, esters, terpenes, FDA approved food additives, a monoglyceride, a diglyceride, a triglyceride, a citric triglyceride, a fatty acid, an alcohol, a fatty acid alcohol, a wax, a fiber, cellulose, a ketone, an aldehyde, a protein, a sugar, a salt, a mineral, a vitamin, a carbonate, a ceramic material, an alkane, an alkene, an alkyne, an zacyle halide, a carboxylate, a carboxylic acid, a methoxy, a hydroperoxide, a peroxide, an ether, a hemiacetal, a hemiaketal, an acetal, a ketal, an orthoester, an orthocarbonate ester, and foods, for example, foods approved as food additives by the Japanese ministry of health labour and welfare, or other foods approved as food additives approved by other regulatory agencies in other countries, materials considered safe for use in their intended application (for example, an inactive drug ingredient would be suitably safe for use as the liquid coating for ointments or other drug products). The liquid should not react with the product in a way that negatively impacts the product. It is often desirable that the liquid is essentially flavorless or essentially odorless, but the liquid can also have flavors and odors, especially those which enhance the product. Suitable liquids can contain additives, for example including FDA approved drugs or inactive drug ingredients.

In some embodiments particles can be added to the liquid, such that the particles form the texture of a liquid-impregnated surface.

In some embodiments, the materials included in any of the liquid surface films described herein can be flavorless or have high flavor thresholds (e.g., containing one or more flavorants at a concentration below 500 ppm), and can be odorless or have a high odor threshold. In some embodiments, the materials included in any of the liquid surface films described herein can be substantially transparent. For example, the liquid and the container materials can be selected so that they have substantially the same or similar indices of refraction (this type of materials selection is sometimes referred to as "index matching"). When coated containers of the present disclosure are formed using index-matched materials, they may exhibit desirable optical properties, such as reduced light scattering and improved light transmission. For example, by utilizing materials that have similar indices of refraction and have a clear, transparent property, a surface having substantially transparent characteristics can be formed.

In some embodiments, the liquid can include an FDA approved health or beauty product, a flavor, a fragrance, and/or one or more additives. The additive can be configured, for example, to reduce the viscosity, vapor pressure, and/or solubility of the liquid. In some embodiments, the additive can be configured to increase the chemical stability of the liquid surface film once formed, for example the additive can be an anti-oxidant configured to inhibit oxidation of the liquid surface film. In some embodiments, the additive can be added to reduce or increase the freezing point of the liquid. In some embodiments, the additive can be configured to reduce the diffusivity of oxygen or $CO_2$ through the liquid surface film, or enable the liquid surface film to absorb more ultra violet (UV) light, for example to protect the product (e.g., any of the products described herein) contained within a container on which the liquid surface film is disposed. In some embodiments, the additive can be configured to impart an intentional odor, for example a fragrance (e.g., smell of flowers, fruits, plants, freshness, scents, etc.), to the liquid surface film. In some embodiments, the additive can be configured to provide color to the liquid surface film and can include, for example, a dye or an FDA approved color additive. In some embodiments, the liquid surface film includes an additive that can be released (e.g., instantaneously upon contact with a product, or over time through controlled release) into the product, for example, a flavor or a preservative. Additives according to some embodiments of the present disclosure may be granular and "encapsulated" such that they do not contact, dissolve into, or other become incorporated in the product until they have been chemically and/or mechanically altered (e.g., slow dissolution of an encapsulate material over time through solubility with the product, and/or rupture through mechanical action).

In some embodiments, the liquid surface film includes a liquid having a melting point that is higher than the temperature at which the container bearing said liquid surface film would typically be stored, shipped, transported, etc. In other words, the liquid may be frozen during certain such periods. When the liquid surface film is solidified through freezing, it dissolves much more slowly (e.g., in the presence of an adjacent product), and to a lesser extent, thereby enhancing the lifetime of the liquid surface film during storage. Upon thawing, the liquid surface film regains the performance characteristics that it had prior to freezing (i.e., its "slippery" properties). This ability to freeze the liquid component of the liquid surface film may be desirable, for example, during periods of time when the liquid surface film has been applied to a container but the container does not yet contain a product, or when a product within a container coated with the liquid surface film does not yet need to be dispensed (e.g., during shipment or storage).

In some embodiments, the materials included in any of the liquid surface films described herein can be recyclable. For example, the liquid can comprise or include one or more materials that wash away during standard container (e.g., glass bottle, plastic bottle, etc.) recycling processes. For example, the liquid surface film can be configured to pass standard recycling tests provided by the Association for Postconsumer Plastic Recyclers (e.g., successful removal using the typical wash used in PET bottle recycling). In some embodiments, the liquid surface film can be configured to dissolve in a caustic wash, for example a solution of Triton X 100 or sodium hydroxide (NaOH) at high temperature, an acid wash, a solvent wash, or any other dissolving solution.

In some embodiments, any of the liquid surface films described herein can include, for example, preservatives, sweeteners, color additives, flavors, spices, flavor enhancers, fat replacers, and components of formulations used to replace fats, nutrients, emulsifiers, surfactants, bulking agents, cleansing agents, depilatories, stabilizers, emulsion stabilizers, thickeners, flavor or fragrance, an ingredient of a flavor or fragrance, binders, texturizers, humectants, pH control agents, acidulants, leavening agents, anti-caking agents, anti-dandruff agents, anti-microbial agents, antiperspirants, anti-seborrheic agents, astringents, bleaching agents, denaturants, depilatories, emollients, foaming agents, hair conditioning agents, hair fixing agents, hair waving agents, absorbents, anti-corrosive agents, anti-foaming agents, anti-oxidants, anti-plaque agents, anti-static agents, binding agents, buffering agents, chelating agents, cosmetic colorants, deodorants, detangling agents, emulsifying agents, film formers, foam boosting agents, gel forming agents, hair dyeing agents, hair straightening agents, keratolytics, moisturizing agents, oral care agents, pearlescent agents, plasticizers, refatting agents, skin conditioning agents, smoothing agents, soothing agents, tonics, and/or UV filters.

In some embodiments, the liquid surface film can include materials having an average molecular weight in the range of about 100 g/mol to about 600 g/mol, which are included in the Springer Material Landolt-Bornstein database located at, "http:www.springermaterials.com/docs/index.html", or in the MatNavi database located at "www.mits.nims.go.jp/index_en.html". In some embodiments, the liquid can have a boiling point greater than about 150° C. or greater than about 250° C., such that it is not classified as a volatile organic compound (VOC). In some embodiments, a liquid surface film can include a liquid whose density is substantially equal to the density of the product to be contained within a container bearing the liquid surface film.

Typically, the liquid will have a viscosity of less than 1,000 cP, 100 cP, 50 cP, 20 cP, or 10 cP at room temperature, facilitating coverage of the liquid on a given surface. The liquid will also typically have a vapor pressure of less than or equal to the vapor pressure of water. Where a product is water-based, the liquid should be immiscible with water, or at least have an extremely low miscibility with water. Where a product is oil-based, the liquid should be immiscible in oil, or at least have extremely low miscibility in oil. Partial miscibility of the liquid with the product, including the continuous phase of a colloidal system, can still result in a stable film, especially if the product is saturated with the liquid. Temporary stability of the liquid/product system can also be achieved if the liquid dissolves very slowly within the product. If the product is an emulsion, or a suspension of liquid or solid materials in a liquid phase, then the coating liquid can be chosen, and/or modified with additives or surfactants, such that the liquid exhibits electrostatic or steric repulsive forces to the suspended phase. The additives or surfactants that stabilize the product may also diffuse to the liquid and cause it to repel the suspended phase. The use of steric or electrostatic repulsive forces to prevent agglomeration of particles or droplets in a suspension or emulsion is well understood, and any of the approaches used to achieve such suspension stability can be applied for the purpose of repelling suspended particles from interacting with the liquid or the liquid surface film. In some cases an emulsified liquid in the product may not negatively impact the properties of the liquid (and/or the liquid surface film) if mixed. For example, for embodiments in which the properties of the liquid and the product are similar, it may not be necessary to include an additive or surfactant.

Suitable products (i.e., for containing within liquid surface film coated containers of the present disclosure) include Bingham plastic materials such as toothpaste, mayonnaise, ketchup, gels, lotions, paint, and margarine. Other suitable products include foods and drugs with rheological modifiers which allow the product to exhibit Bingham plastic-like behavior. Without wishing to be bound by any theory, it is believed that in the case where the product is not a Bingham plastic, and for example, is instead a Newtonian liquid, then droplets of the liquid beneath the product would tend to float or sink along a surface, unless the product and liquid have the same density. If the liquid is partially or completely displaced by the product, and the product makes substantial contact with a surface, the product will adhere to the surface (e.g., by way of "pinning sites"), However, in the case where the product exhibits a yield stress—that is, when the product is a Bingham plastic—the buoyant force is not sufficient to overcome the yield stress, so the liquid remains trapped between the product and the surface, resulting in much less contact between the product and the surface.

Figure 4:
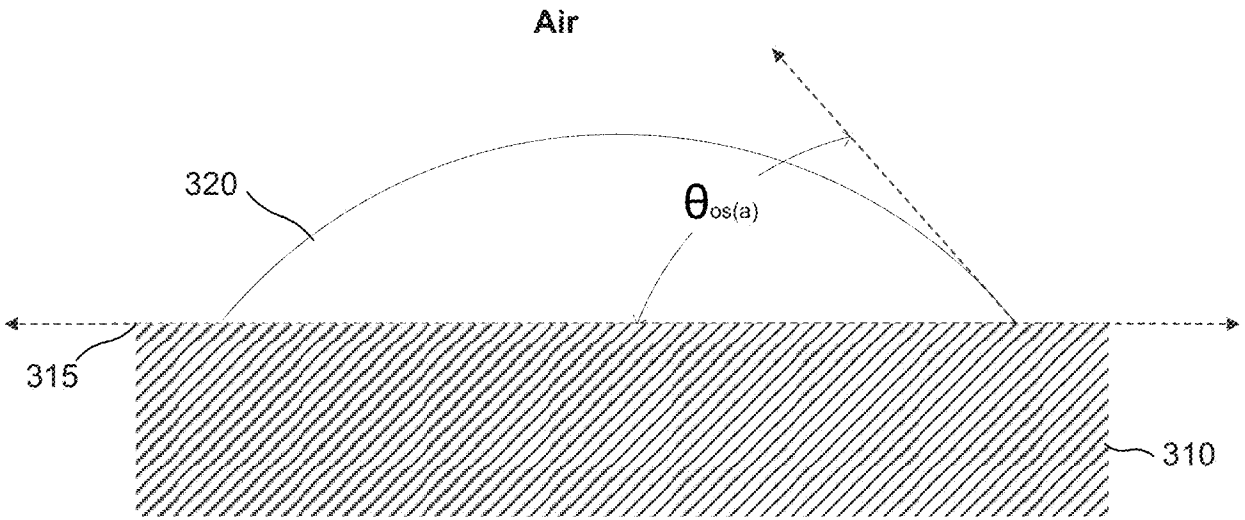
FIG. 4 is an illustration of a liquid on a surface in the presence of air, according to an embodiment.
Figure 5A:
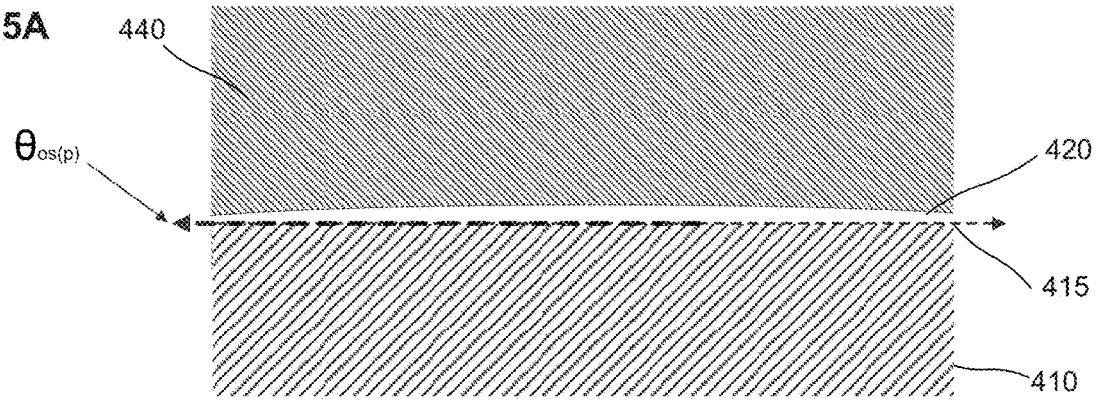
FIGS. 5A-C are illustrations of a liquid on a surface in the presence of a product, according to an embodiments.

FIG. 4 shows a liquid 320 on a surface 315 in the presence of air. Due to differences in surface energy between the liquid 320 and the surface 315, the liquid forms a droplet. Depending on the degree of the difference in surface energy, the profile of the droplet will change. The contact angle formed between the edge of the liquid 320 and the surface 315, and opening toward the drop, can be represented by $\theta_{os(a)}$, where "o" denotes the liquid, "s" denotes the surface, and "a" denotes air. When the liquid is on a surface in the presence of a product, the contact angle, $\theta_{os(p)}$, is formed, where "o" denotes the liquid, "s" denotes the surface, and "p" denotes a product. By way of example, liquid 420 shown in FIG. 5A forms a contact angle $\theta_{os(p)}$ of 0° with surface 415. When $\theta_{os(p)}$ equals 0°, the liquid 420 completely wets (i.e., covers) the entire surface 415, forming a liquid surface film within container 410. This creates a barrier between the product 440 and the surface 415.

Figure 5B:
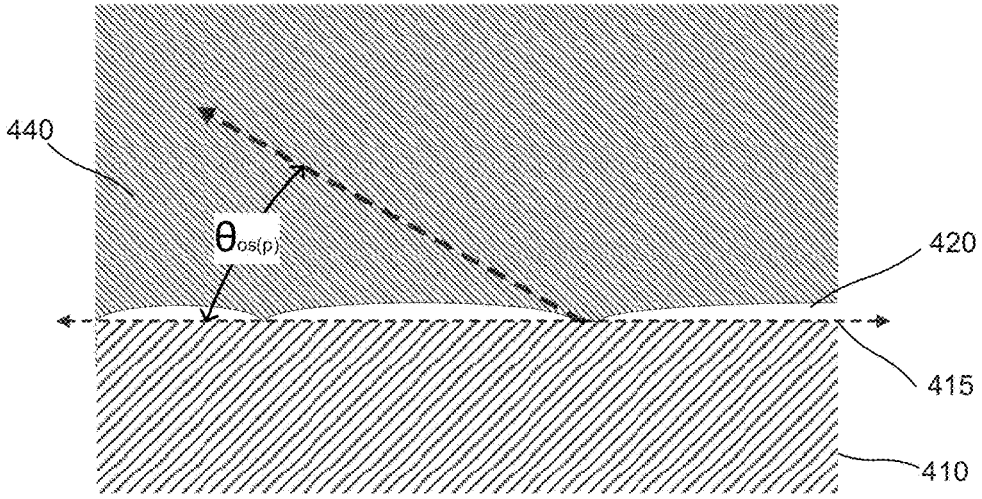

FIG. 5B illustrates a scenario, according to some embodiments of the present disclosure, in which $\theta_{os(p)}$ is non-zero. In this case, a thin film (which may be partially discontinuous and/or of varying thickness) of the liquid 420 had been covering the entire surface prior to being contacted with product, and after contact, the liquid film, being trapped beneath the product 440, breaks up into patches (or "droplets") of liquid that collectively still cover most of the surface 415. Thus, the product 440 still makes very little contact with the surface 415, and the amount of pinning due to regions of direct contact between the product 440 and the surface 415 of container 410, is small enough to allow large areas of the product 440 to remain "out of contact" (i.e., distanced from, spaced from, detached from, and/or the like) with the surface 415. The term "pinning" refers to the effect in which the product 440 displaces the liquid 420, usually in small circular areas on the surface 415, and adheres to the surface 415 of container 410. In the case where $\theta_{os(p)}$ is too high, for example, greater than about 30°, the liquid 420 breaks up further, into individual droplets making less contact with the surface 415, and allowing the product 440 make more contact with, and adhere to, the surface 415.

Figure 5C:
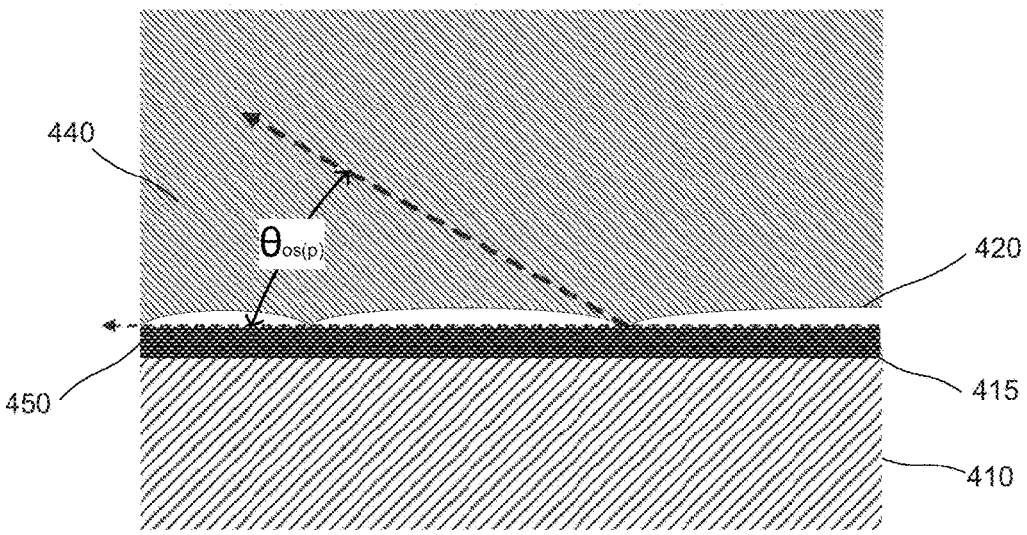

In some embodiments, a container can also include a "native" coating on its interior surface(s) prior to application of the liquid. Where a container itself does not possess a suitable surface for wetting out the liquid, a suitable coating can be first applied to the interior surface(s) of the container prior to disposing the liquid within the container. For example, FIG. 5C depicts a coating 450 on the surface 415 of the container 410. The coating itself can be solid, smooth, textured, rough, and/or porous. A coating can be selected such that $\theta_{os(a)}$ equals 0° and $\theta_{os(p)}$ is less than about 60°. In some embodiments, the contact angle $\theta_{os(p)}$ can be less than about 50°, less than about 40°, less than about 30°, between about 0° and about 60°, between about 1° and about 60°, between about 5° and about 50°, between about 5° and about 40°, between about 5° and about 30°, between about 0° and about 30°, between about 1° and about 30°, between about 1° and about 40°, or between about 1° and 50°, inclusive of all ranges therebetween. In some embodiments, when the product is not a Bingham plastic, $\theta_{os(p)}$ can be equal to about 0°. Alternatively, the surface can have intrinsic roughness that enhances wetting, or the surface can be roughened by chemical and/or or mechanical means, for example by chemical etching or by sandblasting.

Figure 6:
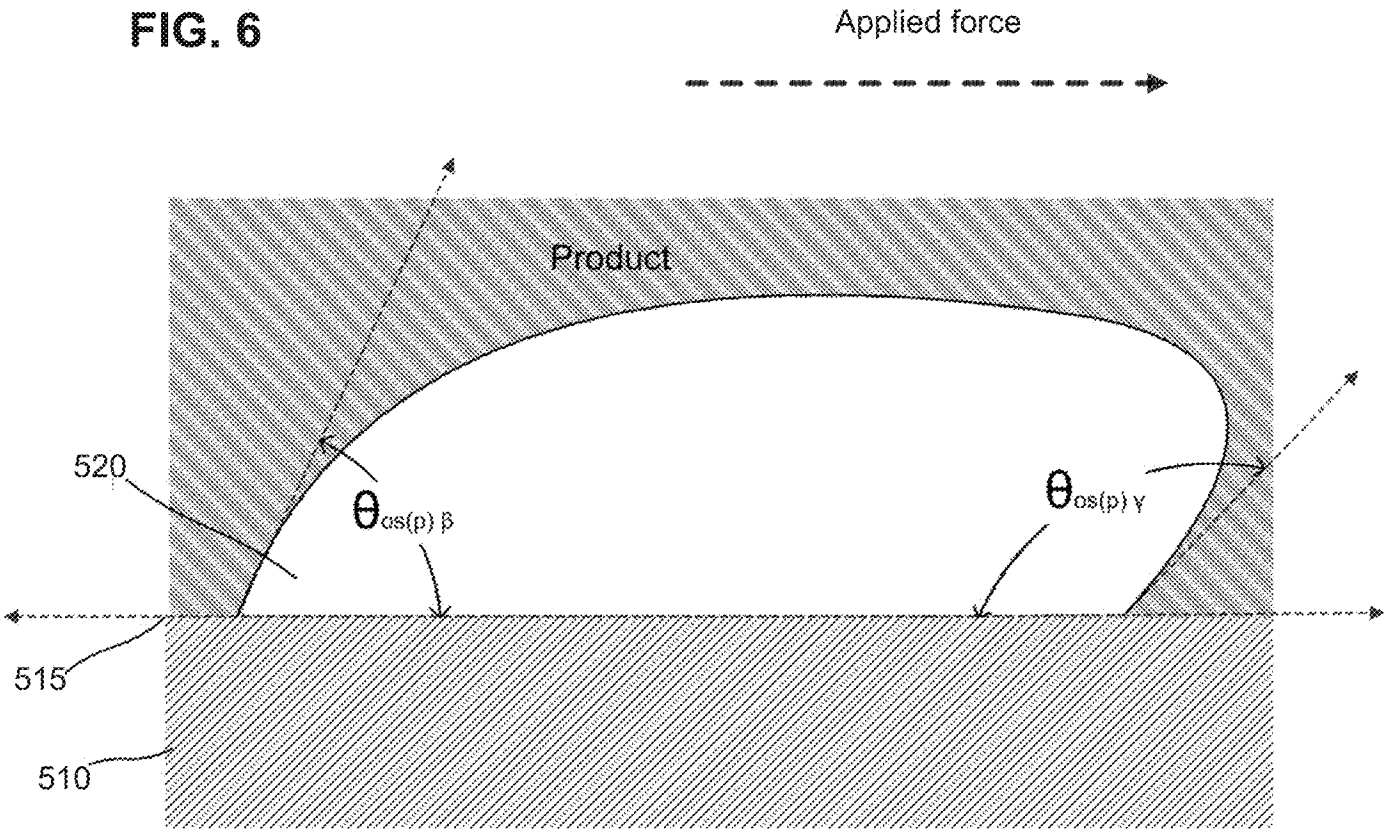
FIG. 6 is an illustration of a liquid on a surface in the presence of air and an applied force according to an embodiment.

FIG. 6 illustrates the receding contact angle $\theta_{os(p)\beta}$, and the advancing contact angle $\theta_{os(p)\gamma}$ of the liquid surrounded by product. Liquid 520 has an applied force which causes the liquid to want to flow across surface 515 in the direction of the applied three. The receding contact angle $\theta_{os(p)\beta}$, is measured on the trailing edge of the liquid 520 relative to the direction of the applied three. The advancing contact angle $\theta_{os(p)\gamma}$, is measured on the leading edge of the liquid 520 relative to the direction of the applied force. $\theta_{os(a)}$ and $\theta_{os(p)}$ can be a measure of the contact angle of a sessile (e.g., stationary or at equilibrium) liquid, or can be a measure of the liquid's receding contact angle, $\theta_{os(p)\beta}$, or advancing contact angle $\theta_{os(p)\gamma}$.

Figure 7B:
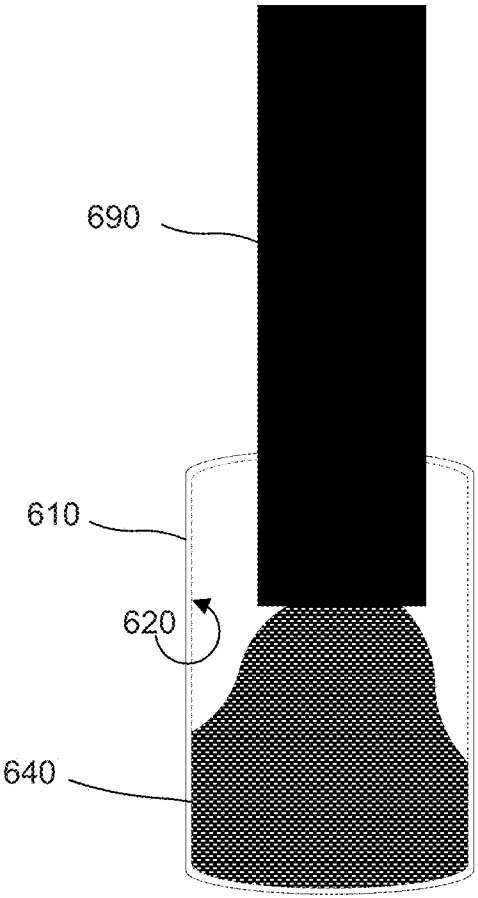
FIGS. 7A-B are illustrations of a method of forming a liquid film in a container, according to an embodiment.
Figure 7A:
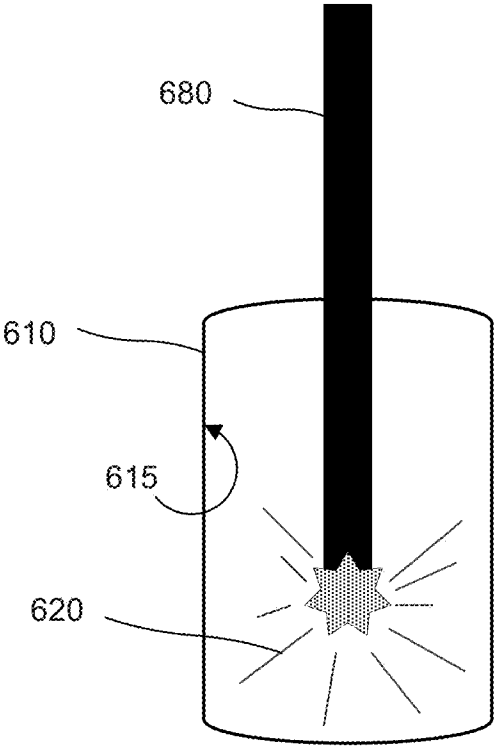

The liquid can be disposed on an interior surface of the container in a number of ways. In some embodiments, the liquid is applied to the container prior to dispensing the product into the container. FIG. 7A shows a method whereby a liquid dispenser 680 sprays a liquid 620 onto the interior surface 615 of container 610. The liquid can also be misted onto or condensed onto the interior surfaces of the container. In some embodiments, the liquid 620 can be poured into the container 610 and the excess liquid 620 can be drained out. In some embodiments, the container 610 can be temporarily immersed in a pool of the liquid 620, such that the liquid 620 coats the inner-surface 615 of the container 710. The liquid can be applied to the container by virtually any suitable method which spreads the liquid onto the interior surfaces thereby forming a film. After forming the film of the liquid 720, a product dispenser 690 fills product 640 into container 610 as shown in FIG. 7B.

Figure 8:
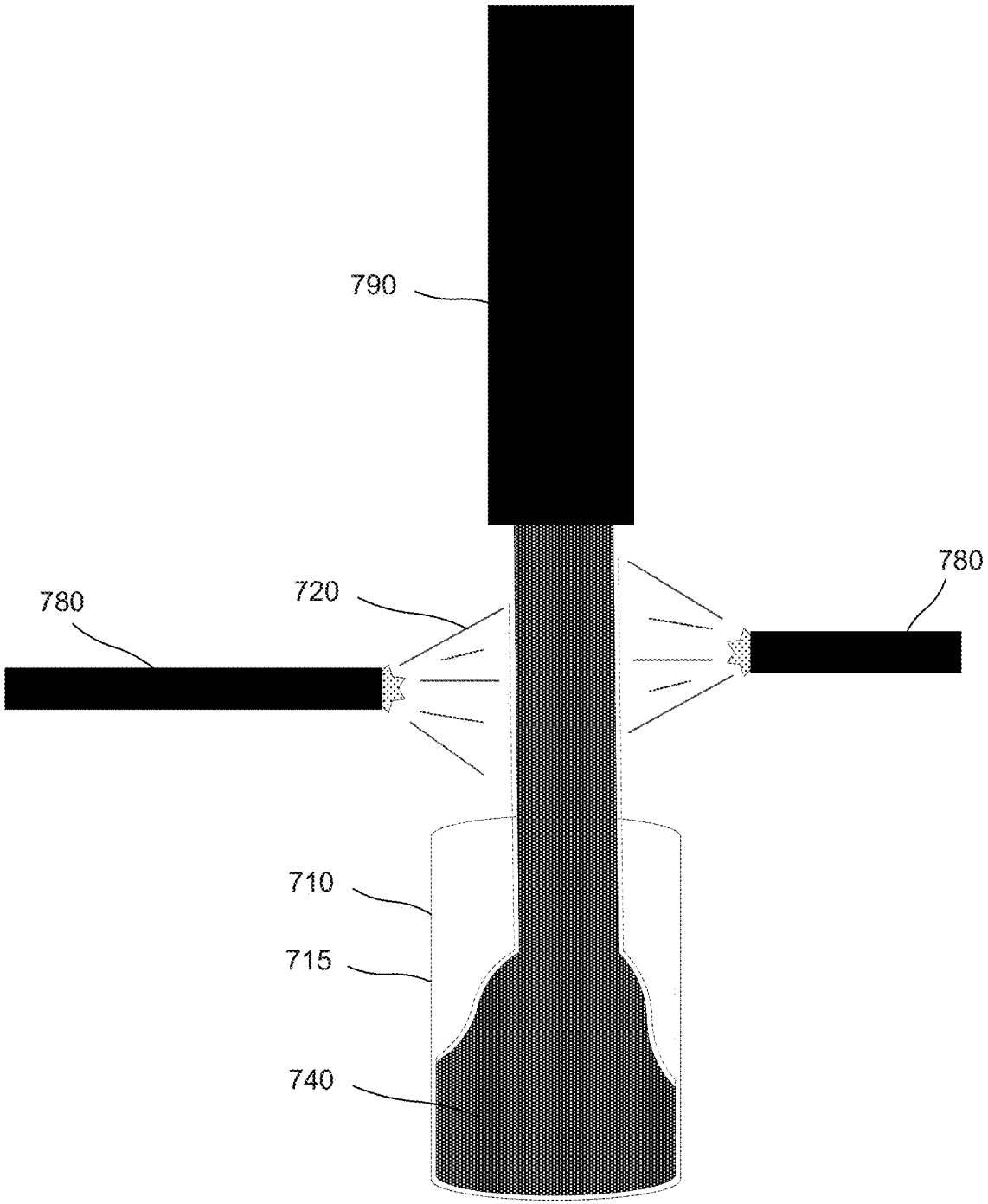
FIG. 8 is an illustration of a method of providing a liquid onto a product, according to an embodiment.

In another embodiment, the liquid is applied to the product as the product is dispensed into the container. For example, as shown in FIG. 8, the liquid 720 can be applied to the product 740 prior to filling container 710. As shown, liquid dispenser 780 sprays liquid 720 onto the product 740 as it is dispensed from product dispenser 790 into container 710. Other methods of dispensing the liquid and coating the product can also be employed. For example, a single nozzle with multiple concentric ports can simultaneously dispense product from the inner port and liquid from the surrounding port. Additionally, the liquid can be injected onto the outside of the product. If the spreading coefficient, $S_{op(a)}$, for the liquid spreading over the product in an air environment is positive, i.e. $S_{op(a)}=\gamma_{pa}-\gamma_{op}-\gamma_{ea}>0$, then the liquid will spread over the product upon contact, forming a zero degree contact angle with the product ($\theta_{op(a)}$), and as the product comes in contact with a surface that does not yet have a liquid coating, the liquid that is on the product will form a stable film of liquid (or stable patches of the liquid) between the product and the surface.

In some embodiments $\theta_{op(a)}$ is 0 degrees, where $\theta_{op(a)}$ is a receding contact angle. In some embodiments $\theta_{op(a)}$ is 0 degrees, where $\theta_{op(a)}$ is an advancing contact angle.

In some embodiments, a container may include one or more interior surfaces having a liquid disposed thereon in any manner described herein, as well as one or more interior surfaces having a liquid-impregnated surface, comprising a plurality of solid features and a liquid disposed thereon and/or therebetween, such as the liquid-impregnated surface described with reference to FIG. 1. For example, the top half of an inner surface area of a container may comprise a liquid-only coating, while the bottom half of said inner surface area may comprise the liquid-impregnated type of coating. It is further contemplated by this disclosure that such regions of liquid-only and/or liquid-impregnated coatings/films may be applied in a "pattern" to the interior surface of a container, for example in bands, strips, closed-cell networks of shapes, open-cell networks of shapes, and/or the like. In some embodiments, a liquid-only coating, a liquid-impregnated coating, or both, may be disposed on an exterior surface of a container either instead of or in addition to on an interior surface thereof.

While particular embodiments described herein have been illustrated and described, it would be evident to those skilled in the art that various other changes and modifications can be made without departing from the spirit and scope of the disclosure. All such changes and modifications are therefore also contemplated by the present disclosure, and within the scope thereof.

The invention claimed is:

1. An apparatus for containing a product, the apparatus comprising:

a container having an interior surface; and a liquid disposed on the interior surface;

wherein the interior surface and the liquid are configured such that: (i), the liquid covers substantially all of the interior surface in the absence of a product, (ii) the liquid is separated into patches upon contact between the liquid and the product, the patches covering most of the interior surface, (iii) a liquid-air interface has a contact angle, $\Theta_{os(a)}$, of about 0°, and (iv) a liquid-product interface has a contact angle, $\Theta_{os(p)}$, between about 1° and about 30° with respect to the interior surface, wherein subscript "o" denotes the liquid, subscript "s" denotes the interior surface, subscript "a" denotes air, and subscript "p" denotes the product; and wherein the product is a Bingham plastic.

2. The apparatus of claim 1, wherein the contact angle $\Theta_{os(p)}$ is a receding contact angle.

3. The apparatus of claim 1, wherein $\Theta_{os(a)}$ is a receding contact angle and equal to about 0°, and $\Theta_{os(p)}$ is a receding contact angle and is between about 0° and about 30°.

4. The apparatus of claim 1, wherein the liquid is an additive or contains an additive.

5. The apparatus of claim 1, wherein the liquid is substantially flavorless or substantially odorless.

6. The apparatus of claim 1, wherein the liquid has a viscosity of less than 1000 cP at room temperature.

7. The apparatus of claim 1, wherein $\Theta_{os(a)}$ and $\Theta_{os(p)}$ are receding contact angles.

8. An apparatus comprising:

a container having an interior surface defining an inner volume;

a liquid having a first density disposed on the interior surface; and a product having a second density disposed in the inner volume of the container, the second density approximately equal to the first density, wherein the interior surface and the liquid are configured such that: (i) the liquid covers substantially all of the interior surface in the absence of a product, (ii) the liquid is separated into patches upon contact between the liquid and the product, the patches covering most of the interior surface, (iii) a liquid-air interface has a contact angle, $\Theta_{os(a)}$ of about 0°, and (iv) a liquid-product interface has a contact angle, $\Theta_{os(p)}$, of between about 1° and about 30° with respect to the interior surface, wherein subscript "o" denotes the liquid, subscript "s" denotes the interior surface, subscript "a" denotes air, and subscript "p" denotes the product, and wherein the product is a Bingham plastic.

9. The apparatus of claim 1, wherein $\Theta_{os(a)}$ and $\Theta_{os(p)}$ are contact angles of sessile drops.

10. The apparatus of claim 1, wherein $\Theta_{op(a)}$ is about 0°, and wherein $\Theta_{op(a)}$ is a receding contact angle or an advancing contact angle.

11. The apparatus of claim 2, wherein the product is a food or a drug.

12. The apparatus of claim 4, wherein the additive is an FDA approved drug or an inactive drug ingredient.

13. The apparatus of claim 2, wherein the liquid is immiscible with water, and the product is water-based.

14. The apparatus of claim 2, wherein the liquid is insoluble in oil, and the product is oil-based.

15. The apparatus of claim 14, wherein the liquid has a vapor pressure equal to or less than the vapor pressure of water.

16. The apparatus of claim 1, wherein the interior surface is at least one of rough, textured, and porous.

17. The apparatus of claim 2, wherein the product is toothpaste.

18. The apparatus of claim 2, wherein the product has a yield stress greater than zero prior to flowing.

19. The apparatus of claim 2, wherein the Bingham plastic is at least one of a toothpaste, a ketchup, a margarine, a mayonnaise, an uncured cement, an uncured concrete, a bitumen, a grease, a molten polymer, a gel, a lotion, a drug, or a paint.

20. The apparatus of claim 1, wherein $\Theta_{op(a)}$ is about 0°, and where $\Theta_{op(a)}$ is a receding contact angle or an advancing contact angle.

21. The apparatus of claim 8, wherein $\Theta_{op(a)}$ is about 0°, and where $\Theta_{op(a)}$ is a receding contact angle or an advancing contact angle.

* * * * *